US007584790B2

(12) United States Patent
Johnson

(10) Patent No.: US 7,584,790 B2
(45) Date of Patent: Sep. 8, 2009

(54) METHOD OF ISOLATING AND COMPLETING MULTI-ZONE FRAC PACKS

(75) Inventor: Michael H. Johnson, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 103 days.

(21) Appl. No.: 11/649,559

(22) Filed: Jan. 4, 2007

(65) Prior Publication Data

US 2008/0164026 A1 Jul. 10, 2008

(51) Int. Cl.
*E21B 43/26* (2006.01)

(52) U.S. Cl. ..... 166/271

(58) Field of Classification Search ..... 166/278, 166/313, 308.1, 271, 191, 51, 250.1, 177.5
See application file for complete search history.

(56) References Cited

U.S. PATENT DOCUMENTS 4,270,608 A * 6/1981 Hendrickson et al. ..... 166/278
4,440,226 A 4/1984 Suman, Jr.
5,026,074 A * 6/1991 Hoes et al. ..... 277/336
5,184,677 A 2/1993 Dobscha et al.
5,197,542 A 3/1993 Coone
5,411,090 A * 5/1995 Cornette et al. ..... 166/278
5,609,204 A * 3/1997 Rebardi et al. ..... 166/51
5,988,276 A 11/1999 Oneal
6,009,951 A 1/2000 Coronado et al.
6,230,803 B1 * 5/2001 Morton et al. ..... 166/278
6,263,966 B1 * 7/2001 Haut et al. ..... 166/278
6,311,722 B1 * 11/2001 Gounot et al. ..... 137/382
6,311,772 B1 11/2001 Myhre et al.
6,446,717 B1 9/2002 White et al.
6,513,600 B2 2/2003 Ross
6,513,601 B1 2/2003 Gunnarsson et al.

(Continued)

FOREIGN PATENT DOCUMENTS

GB 2381811 A 5/2003

OTHER PUBLICATIONS

Vickery E. Harold, et al., "New One-Trip Multi-Zone Frac Pack System with Positive Positioning", SPE 78316, Oct. 2002, 1-8.

(Continued)

*Primary Examiner*—Jennifer H Gay
*Assistant Examiner*—James G Sayre
(74) *Attorney, Agent, or Firm*—Steve Rosenblatt LLP

(57) ABSTRACT

Multiple formations are isolated in the wellbore and fractured and gravel packed together. The bottom hole assembly can have a series of screens that are separated with packers in between and above and below the screen stack. The assembly is positioned where needed in the borehole and the topmost and lowermost packers (if used) are set. The bottom of the interval can alternatively be the hole bottom. With multiple intervals isolated a fracturing operation can take place for the entire isolated interval that can encompass multiple producing zones. The interval can also be gravel packed in a single operation. After the gravel pack of the interval, packers that are on the bottom hole assembly between screens that are aligned with perforations for different zones can be set into the gravel pack and get an effective seal against the casing to isolate the various producing zones from each other.

13 Claims, 4 Drawing Sheets

U.S. PATENT DOCUMENTS

| | | | | |
|---|---|---|---|---|
| 6,543,538 | B2 | 4/2003 | Tolman et al. | |
| 6,578,638 | B2 | 6/2003 | Guillory et al. | |
| 6,612,372 | B1 | 9/2003 | Freiheit et al. | |
| 6,732,800 | B2 | 5/2004 | Acock et al. | |
| 6,769,491 | B2 | 8/2004 | Zimmerman et al. | |
| 6,782,946 | B2 | 8/2004 | Perkins et al. | |
| 6,782,948 | B2 * | 8/2004 | Echols et al. | 166/278 |
| 6,827,150 | B2 | 12/2004 | Luke | |
| 6,840,325 | B2 | 1/2005 | Stephenson | |
| 6,896,049 | B2 * | 5/2005 | Moyes | 166/82.1 |
| 6,907,937 | B2 | 6/2005 | Whanger et al. | |
| 7,100,690 | B2 | 9/2006 | Mullen et al. | |
| 2002/0148612 | A1 * | 10/2002 | Cook et al. | 166/313 |
| 2005/0061511 | A1 | 3/2005 | Steele | |
| 2006/0000614 | A1 | 1/2006 | Restarick et al. | |

OTHER PUBLICATIONS

Marshall, John, et al., "Unique Cost Effective Technique for One Trip Selective Gravel Packing Over Multiple Zones: Dacion Field Cas Study", IADC/SPE 59168, Feb. 2000, 1-11.

Vickery, Harold, et al., "One-Trip Multizone Frac Packs in Bohai Bay—A Case Study in Efficient Operations", SPE 90173, Sep. 2004, 1-10.

Vickery, E. Harold, et al., "Application of One-Trip Multi-Zone Gravel Pack to Maximize Completion Efficiency", SPE 64469, Oct. 2000, 1-10.

* cited by examiner

METHOD OF ISOLATING AND COMPLETING MULTI-ZONE FRAC PACKS

FIELD OF THE INVENTION

The field of this invention is well completions and more particularly completions that allow multi-zone completions that call for fracturing, gravel packing and isolation in a single trip.

BACKGROUND OF THE INVENTION

In the past in the case of a broad pay zone or multi pay zone to be completed the procedure was to break it into sections. The fracturing and gravel packing equipment is run into cased and perforated hole along with an isolation packer. The packer would be set to isolate the lowermost zone and the isolated zone would then be fractured below that packer. Thereafter, gravel would be delivered outside screens through a crossover to fill the annular space around the screen with gravel. After that the packer would remain in the zone just gravel packed along with the screens with gravel on their exterior as the crossover and associated wash pipe were pulled out through the already set packer. After that zone was isolated, fractured, and gravel packed another trip in the hole with a similar assembly as used for the lowest zone would be run in for doing the same for the next zone up. This process continued until all zones or sections of a continuous zone were completed.

This technique required many trips in and out of the wellbore and that translated into very high expenses for rig time. One of the reasons that this staged procedure was used was that to do it another way where an entire interval could be isolated and fractured and gravel packed at once required packers to then be set in the annulus after gravel packing. The packers that had been available were not known for reliable sealing against the inside wall of casing if the annular space was full of gravel.

More recently packer designs have evolved and sealing in an annulus that is full of gravel is possible. An example of such a packer is U.S. Pat. No. 6,896,049. Other packer designs are illustrated in U.S. Pat. Nos. 6,782,946; 5,988,276; 6,009,951; 7,100,690; 5,184,677 and 6,513,600.

The present method involves the use of packers that can reliably seal against casing in an annulus filled with gravel so that in one trip an entire interval or discrete pay zones can be isolated at once and fractured and then gravel packed and then packers that are already in place to either split up one zone or to isolate spaced zones can be set where gravel is present in the annular space. This allows these three procedures to be done in one trip for multiple zones or discrete segments of a single zone and still allow reliable isolation between zones or segments to occur with packers that can get a seal in a gravel environment. Different packer designs are contemplated for this service. These and other aspects of the present invention will be more readily apparent from a review of the description of the preferred embodiment and the associated drawings while recognizing that the claims determine the full scope of the invention.

SUMMARY OF THE INVENTION

Multiple formations are isolated in the wellbore and fractured and gravel packed together. The bottom hole assembly can have a series of screens that are separated with packers in between and above and below the screen stack. The assembly is positioned where needed in the borehole and the topmost and lowermost packers (if used) are set. The bottom of the interval can alternatively be the hole bottom. With multiple intervals isolated a fracturing operation can take place for the entire isolated interval that can encompass multiple producing zones. The interval can also be gravel packed in a single operation. After the gravel pack of the interval, packers that are on the bottom hole assembly between screens that are aligned with perforations for different zones can be set into the gravel pack and get an effective seal against the casing to isolate the various producing zones from each other.

DETAILED DESCRIPTION OF THE PREFERRED EMBODIMENT

Figure 1:
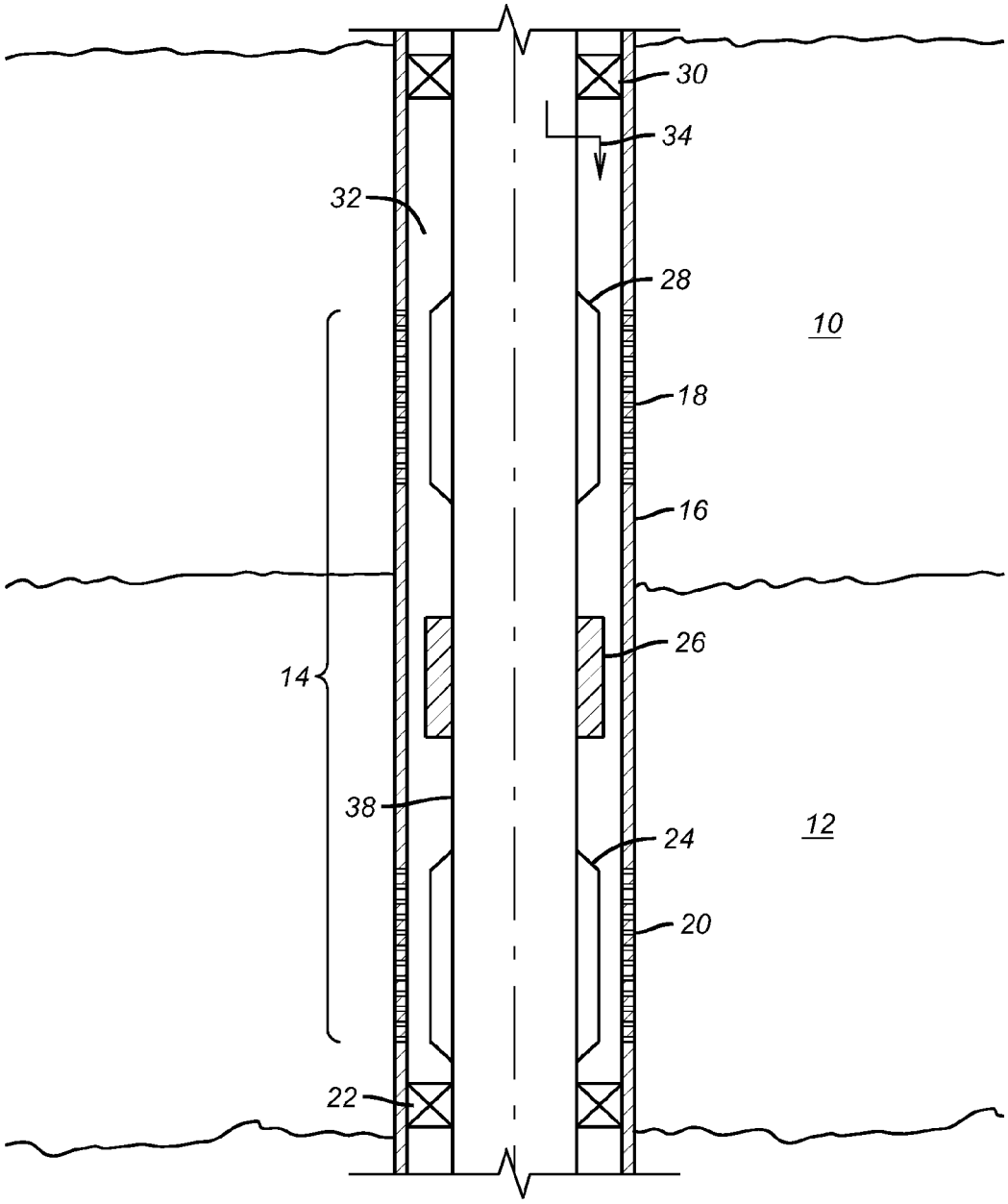
FIG. 1 is a run in view of a multi-zone completion in position with a lower packer set.

Referring to FIG. 1 two adjacent producing zones 10 and 12 are illustrated as a producing interval 14. The wellbore is cased with casing 16 that has perforations 18 and 20 respectively in zones 10 and 12. A bottom hole assembly shown in FIG. 1 comprises a bottom packer 22 which can optionally be eliminated if there are no producing zones below the shown location for packer 22. From there and working uphole, there is a lower screen 24 followed by a zone isolation packer 26. Above that are another screen section 28 and an upper packer 30. Annulus 32 is defined between the casing 16 and the bottom hole assembly between packers 22 and 30. As an alternative to packers 22 or 30 the tubular 38 can be expanded against the casing 16 for a metal to metal seal.

Figure 1A:
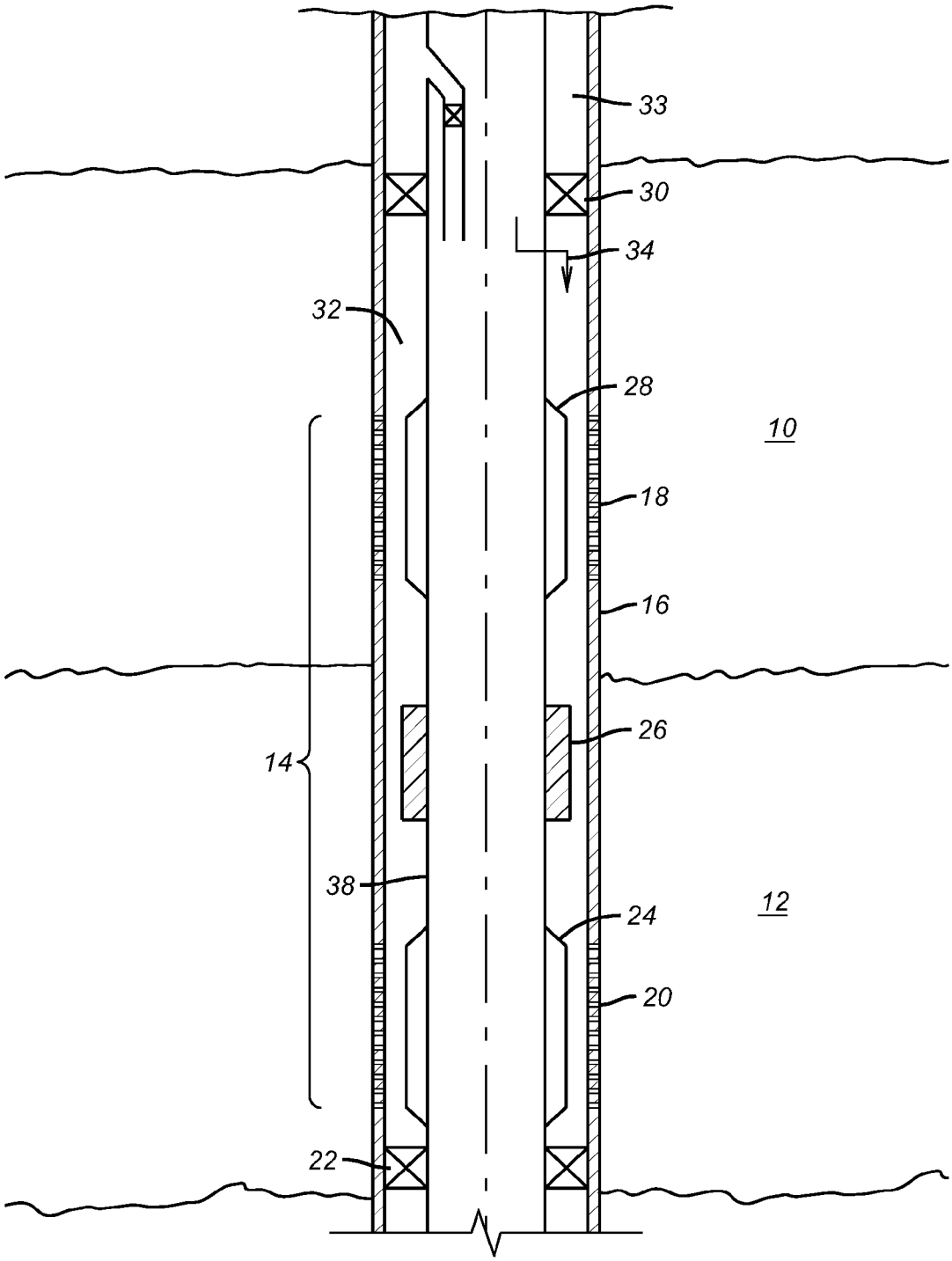
FIG. 1*a* is the view of FIG. 1 during fracturing.
Figure 2:
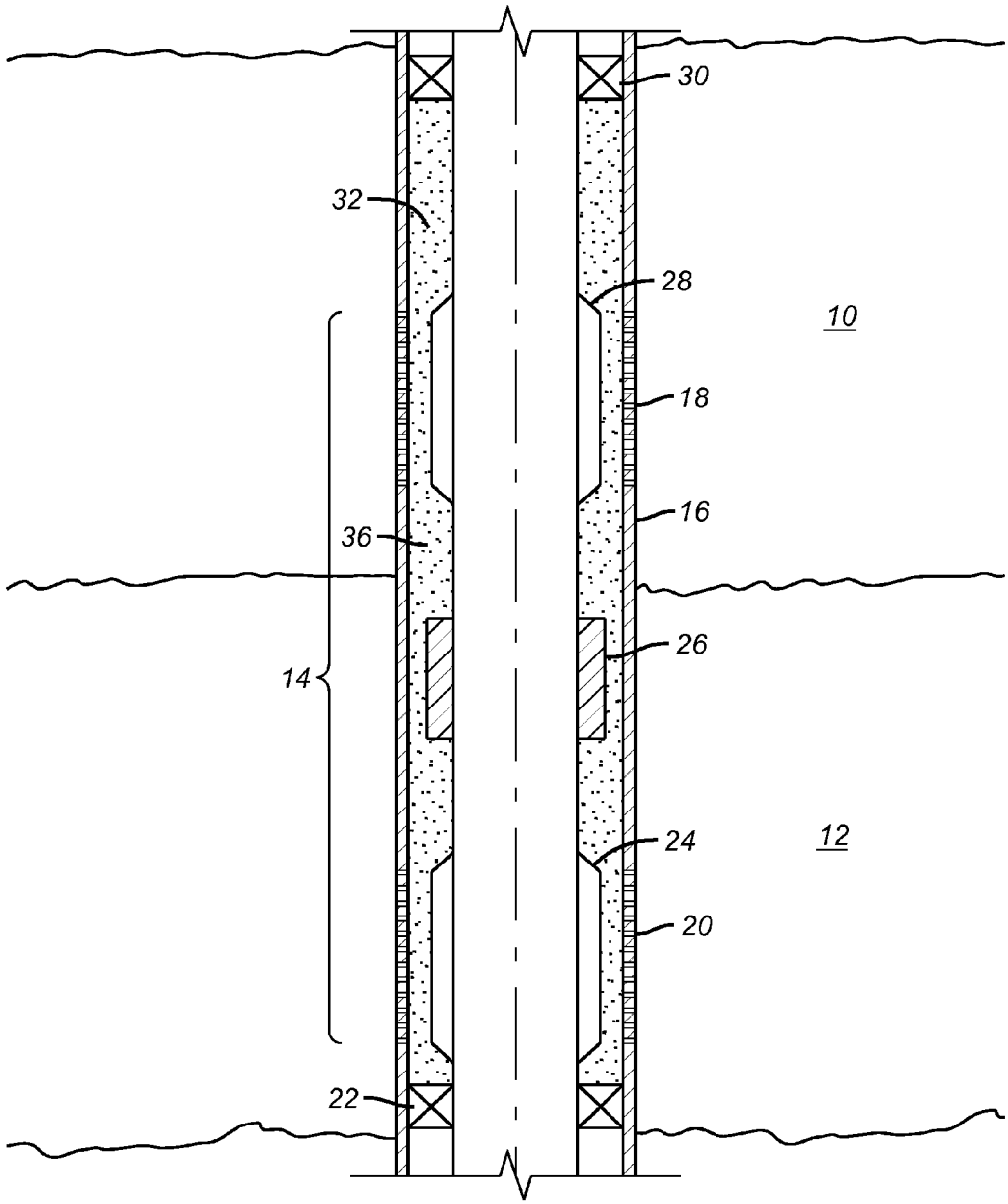
FIG. 2 is the view of FIG. 1*a* after two zones have been fractured and gravel packed.
Figure 3:
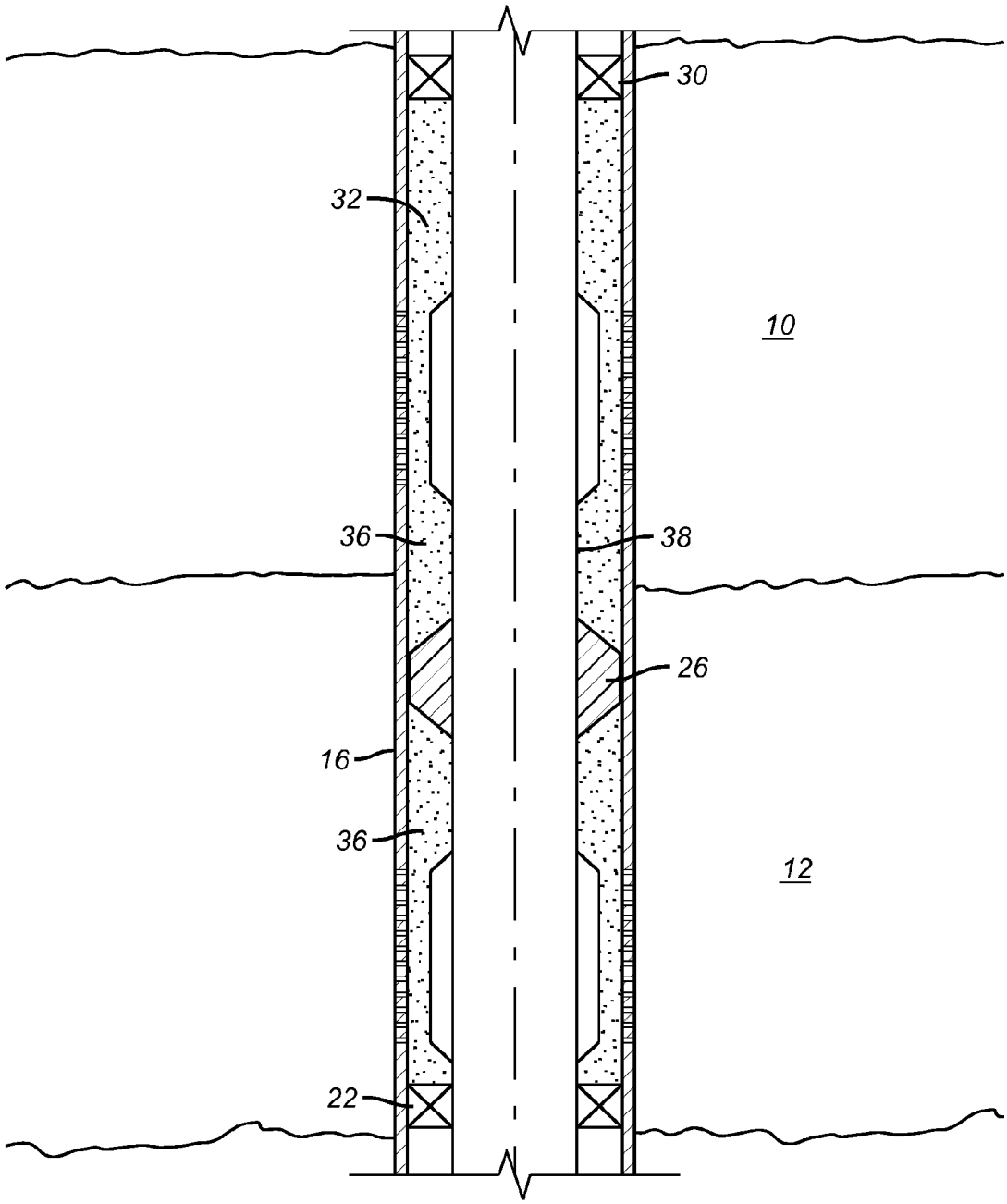
FIG. 3 is the view of FIG. 2 after the packer between screens is set through the gravel to isolate zones in the interval.

Known fracturing and gravel packing tools such as crossovers are mounted with packer 30 to allow fracturing fluid or gravel to pass packer 30 and enter annulus 32 as shown schematically by arrow 34 and to selectively make a return path to upper annulus 33 above the packer 30 as shown in FIG. 1*a*. Arrow 34 represents the ability to fracture and deliver gravel to the annulus 32. For fracturing, if done before gravel packing, as shown in FIG. 1*a*, the return path through packer 30 to upper annulus 33 is closed as schematically illustrated in FIG. 1*a*. For gravel packing that same access to the upper annulus 33 is instead open by crossover manipulation in a manner known in the art. FIG. 2 shows annulus 32 full of gravel 36 between packers 22 and 30. It should be noted that zones 10 and 12 have by this time been fractured together and gravel packed together between set packers 22 and 30 with packer 26 as yet unset. FIG. 3 shows the packer or seal 26 set against the casing 16 after pushing the gravel 36 out of the way and preferably creating a metal to metal seal against the casing 16. Zones 10 and 12 are now isolated from each other in the annulus 32.

Those skilled in the art will appreciate that any number of screen sections separated by packers such as 26 and having a top packer 30 with or without optional packer 22 can be used to fracture and gravel pack more than the two zones illustrated in the FIGS. The zones need not be adjacent as illustrated in the FIGS. Packers 22 and 30 can be of different styles suitable for the application and the anticipated differential pressures. Packers between screen sections should be able to displace a gravel pack 36 to reach the casing 16 to create a seal that will effectively isolate successive zones whether they are close together or not.

As an alternative to using packers such as 26 the tubing 38 can be expanded to seal across the annulus 32 using known expansion methods so that the same result is achieved.

The advantages over the prior sequential techniques for fracturing and gravel packing one zone at a time can now be appreciated. With the delivery of a single bottom hole assembly, multiple zones can be fractured and gravel packed together using known techniques. Thereafter, those zones can be isolated from each other with a gravel packed annulus leaving all zones ready to be produced in a small fraction of the time it takes to accomplish the same condition using the prior techniques.

The above description is illustrative of the preferred embodiment and various alternatives and is not intended to embody the broadest scope of the invention, which is determined from the claims appended below, and properly given their full scope literally and equivalently.

I claim:

1. A downhole wellbore completion method, comprising:

isolating a plurality of zones from the rest of the wellbore downhole with a bottom hole assembly;

placing screens on the bottom hole assembly adjacent at least two said isolated zones;

gravel packing said at least two isolated zones together;

isolating said at least two isolated zones downhole from each other and between said screens after said gravel packing with a barrier that is extended to displace gravel previously deposited around the barrier during said gravel packing of said at least two isolated zones together.

2. The method of claim 1, comprising:

fracturing said at least two zones before said isolating from each other.

3. The method of claim 2, comprising:

expanding a tubular between screens to isolate zones between screens.

4. The method of claim 3, comprising:

expanding a tubular either above or below all screens to isolate multiple zones in the wellbore.

5. The method of claim 1, comprising:

using at least one between screens packer to isolate said at least two zones from each other.

6. The method of claim 5, comprising:

obtaining a metal to metal seal of said between screens packer against a surrounding tubular in the wellbore.

7. The method of claim 5, comprising:

using at least one multi-zone isolation packer located above or below all said screens on the bottom hole assembly.

8. A downhole completion method, comprising:

isolating a plurality of zones downhole with a bottom hole assembly;

fracturing said isolated zones together;

maintaining an isolation device in a retracted position between at least two of said plurality of isolated zones during fracturing;

isolating said zones downhole from each other along said bottom hole assembly with a metal to metal seal after said fracturing by actuating said isolation device.

9. The method of claim 8, comprising:

placing a screen on the bottom hole assembly adjacent at least two zones;

isolating said zones between screens.

10. The method of claim 9, comprising:

using at least one between screens packer to isolate said zones.

11. The method of claim 9, comprising:

expanding a tubular between screens to isolate zones between screens.

12. The method of claim 11, comprising:

expanding a tubular either above or below all screens to isolate multiple zones in the wellbore.

13. The method of claim 9, comprising:

using at least one multi-zone isolation packer located above or below all said screens on the bottom hole assembly.

* * * * *